US009108775B2

(12) United States Patent
Savakus

(10) Patent No.: US 9,108,775 B2
(45) Date of Patent: Aug. 18, 2015

(54) SPACER SEPARATION FOR COATED GLASS SHEETS SUCH AS FIRST SURFACE MIRRORS

(75) Inventor: Hal Savakus, Dexter, MI (US)

(73) Assignee: Guardian Industries Corp., Auburn Hills, MI (US)

( * ) Notice: Subject to any disclaimer, the term of this patent is extended or adjusted under 35 U.S.C. 154(b) by 973 days.

(21) Appl. No.: 11/651,109

(22) Filed: Jan. 9, 2007

(65) Prior Publication Data

US 2008/0164173 A1 Jul. 10, 2008

(51) Int. Cl.
*B65D 57/00* (2006.01)
*B65D 85/48* (2006.01)

(52) U.S. Cl.
CPC ..... *B65D 57/00* (2013.01); *B65D 85/48* (2013.01)

(58) Field of Classification Search
USPC ..... 206/593, 587, 456, 454, 386, 451, 453, 206/585, 586, 594
See application file for complete search history.

(56) References Cited

U.S. PATENT DOCUMENTS

| | | | | |
|---|---|---|---|---|
| 3,292,778 | A * | 12/1966 | Enderle | 206/523 |
| 3,385,462 | A * | 5/1968 | Deldime et al. | 53/447 |
| 3,451,169 | A * | 6/1969 | Bell et al. | 49/462 |
| 3,759,193 | A * | 9/1973 | Branch | 108/53.3 |
| 5,174,448 | A * | 12/1992 | Flaig | 206/386 |
| 5,439,716 | A | 8/1995 | Larsen | |
| 5,813,536 | A | 9/1998 | Bartholomew | |
| 6,102,206 | A | 8/2000 | Pride | |
| 6,783,253 | B2 * | 8/2004 | Thomsen et al. | 359/870 |
| 6,934,085 | B2 * | 8/2005 | Stachowiak et al. | 359/585 |
| 2006/0063010 | A1 | 3/2006 | Lu et al. | |
| 2006/0077580 | A1 | 4/2006 | Wuillaume et al. | |

* cited by examiner

*Primary Examiner* — Anthony Stashick
*Assistant Examiner* — Kaushikkumar Desai
(74) *Attorney, Agent, or Firm* — Nixon & Vanderhye P.C.

(57) ABSTRACT

Certain example embodiments of this invention relate to an apparatus, system and/or method for holding coated glass sheets (e.g., mirrors) during transport, storage and/or the like. In certain example, embodiments, spacers are used between adjacent glass sheets so as to reduce the amount of contact between the spacers and the glass sheets when such glass sheets are stored and/or transported.

13 Claims, 3 Drawing Sheets

SPACER SEPARATION FOR COATED GLASS SHEETS SUCH AS FIRST SURFACE MIRRORS

FIELD OF THE INVENTION

Certain example embodiments of this invention relate to an apparatus and/or system for holding coated glass sheets such as first surface mirrors (FSMs). In certain example embodiments, the apparatus and/or system reduces the amount of contact between spacer separators and glass sheets when such glass sheets (e.g., FSMs, or any other suitable type of coated glass sheet) are stored and/or transported. In certain example instances, certain example embodiments of this invention relate to stacked glass sheets separated by at least substantially rectangular prism shaped strips at one end of the glass sheets and substantially U-shaped strips located at the other end of every-other glass sheet in the stack. Certain example embodiments relate to a series of tabs disposed around the perimeter of glass sheets. The strips and tabs may be used in various combinations and configurations.

BACKGROUND AND SUMMARY OF EXAMPLE EMBODIMENTS OF THE INVENTION

Glass sheets may include coated glass sheets, uncoated glass sheets, IG window units, and the like. One particular type of coated glass sheet is a first surface mirror (also sometimes called a front surface mirror, or FSM). FSMs may be used, for example, in high-definition rear projection display televisions, as disclosed, for example, in U.S. Pat. Nos. 6,783,253 and 6,934,085, each hereby incorporated herein by reference in its entirety.

Coated glass sheets such as first surface mirrors are susceptible to surface damage during transportation and/or storage. Damage to a first surface mirror may render the entire glass sheet scrap, as small nicks and/or scratches may be seen on the displayed television image. As such, manufacturers often go to great lengths to carefully package glass sheets for transportation to a customer (e.g., assembly) site.

Current packaging techniques often use a foam sheet separator (e.g., typically polyethylene or polypropylene) alone or in combination with an anti-tarnish tissue to cushion and protect the glass sheet surface. FIGS. 1*a* and 1*b* illustrate this conventional packaging technique. In particular, FIG. 1*a* is a front view of foam sheets 10 disposed between glass sheets 12 according to a conventional packaging technique, and FIG. 1*b* is a perspective view of the packaging technique of FIG. 1*a*. As will be appreciated from FIGS. 1*a* and 1*b*, this packaging technique results in the entire surface of the glass sheet coming into contact with a foreign substance (e.g., the foam sheet).

Even though foam sheets are designed to protect the glass sheets, the presence of debris on, or contamination of, the foam can cause damage (e.g., scratches, nicks, etc.) to the mirror surface, thus potentially rendering the glass sheet inappropriate or not suitable for its intended use. Indeed, the chances of damage to the glass sheet (e.g., FSM or any other suitable type of coated glass sheet) may be increased because the foam sheet comes in contact with an entire major surface(s) of the glass sheet. Thus, it will be appreciated by those of skill in the art that further improvements to conventional packaging techniques are needed.

Certain example embodiments of this invention relate to an apparatus, method, and/or system for holding coated glass sheets such as first surface mirrors (FSMs) during transport or the like. In certain example embodiments, the apparatus, method and/or system is advantageous in that it permits a reduced amount of contact between a surface of the coated glass sheet and one or more separators when the coated glass sheets are stacked for transit and/or storage.

Moreover, certain example embodiments of this invention relate to an apparatus, method, and/or system for holding coated glass sheets such as first surface mirrors (FSMs) during transport or the like, and include air gaps created between the surfaces of adjacent coated glass sheets by placing one or more separators (e.g., strips and/or tabs) around the perimeters of glass sheets at opposing ends (e.g., around the perimeters of the tops and bottoms) thereof.

Certain example embodiments of this invention relate to holding a plurality of coated glass sheets in substantially parallel, spaced-apart relation to one another.

Accordingly, in certain example embodiments, there is provided an apparatus for holding a plurality of glass sheets in substantially parallel spaced-apart relation to each other comprising a plurality of substantially U-shaped strips. Each said substantially U-shaped strip may be disposed around a top end of every other glass sheet and may have a base from which two legs extend downward around each side of the associated glass sheet in certain example instances. The apparatus may further comprise a plurality of second strips. Each said second strip (possibly different than the U-shaped strip(s)) may be disposed along a bottom end of every glass sheet and may be associated with a leg of a substantially U-shaped strip so as to form an air gap therebetween.

In certain other example embodiments, there is provided an apparatus for holding a plurality of glass sheets in substantially parallel spaced-apart relation to each other comprising a plurality of tabs disposed around at least a portion of each glass sheet's perimeter such that the tabs separate the glass sheets so as to create air gaps between adjacent glass sheets.

In still other example embodiments, there is provided an apparatus for holding a plurality of glass sheets in substantially parallel spaced-apart relation to each other comprising a plurality of first spacers and a plurality of second spacers. Each second spacer may be associated with at least one first spacer so as to define a air gap therebetween. The first spacers and second spacers may be disposed around at least a portion of the glass sheets' respective perimeters.

BRIEF DESCRIPTION OF THE DRAWINGS

These and other features and advantages will be better and more completely understood by reference to the following detailed description of exemplary illustrative embodiments in conjunction with the drawings, of which.

DETAILED DESCRIPTION OF EXAMPLE EMBODIMENTS OF THE INVENTION

Certain example embodiments of this invention relate to an apparatus, method, and/or system for holding coated glass sheets such as first surface mirrors (FSMs) or low-E coated glass sheets. In certain example embodiments, the apparatus and/or system reduces the amount of contact between a surface of the coated glass sheet and one or more separators when glass sheets are stacked for transit and/or storage. In particular, certain example embodiments create air gaps between the surfaces of adjacent glass sheets by placing one or more separators (e.g., strips and/or tabs) around the perimeters of glass sheets at opposing ends (e.g., around the perimeters of the tops and bottoms) thereof. In this way, the glass sheets may be held in substantially parallel, spaced-apart relation to one another. The glass sheets may be coated glass sheets such as first surface mirrors or low-E coated glass sheets, uncoated glass sheets, IG window units, or the like. Note that when the coated glass sheets are FSMs, the mirror coating typically includes at least one metallic or substantially metallic reflecting layer of Al, Ag or the like, and one or more dielectric layer(s) (e.g., see U.S. Pat. Nos. 6,783,253, 6,934,085, 2006/0063010, and/or 2006/0077580 which are all incorporated herein by reference).

Figure 1A:
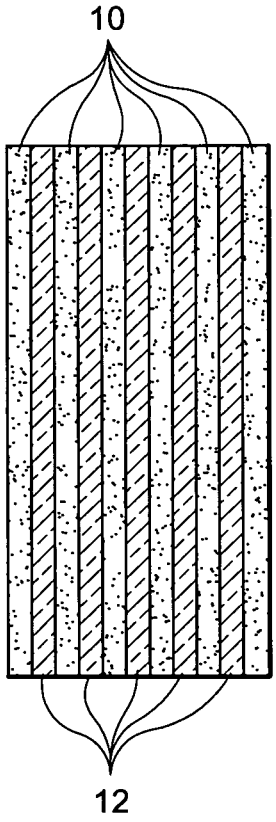
Fig. 1a (Prior Art)
FIG. 1*a* is a front cross-sectional view of foam sheets disposed around glass sheets according to a conventional packaging technique.
Figure 1B:
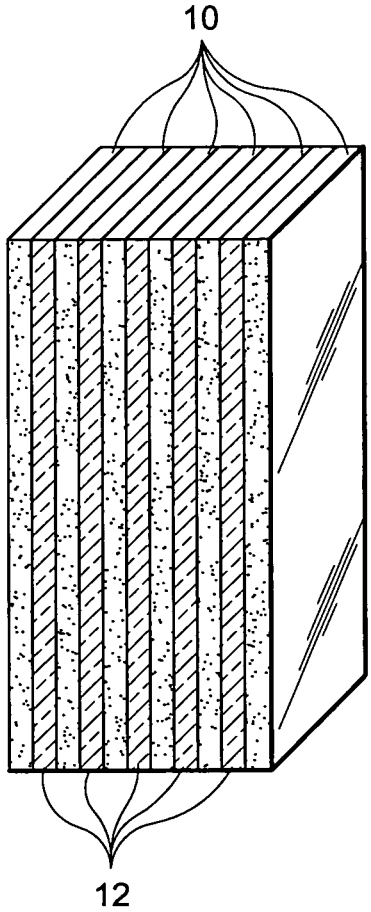
Fig. 1b (Prior Art)
FIG. 1*b* is a perspective view of the packaging technique of FIG. 1*a;*
Figure 2A:
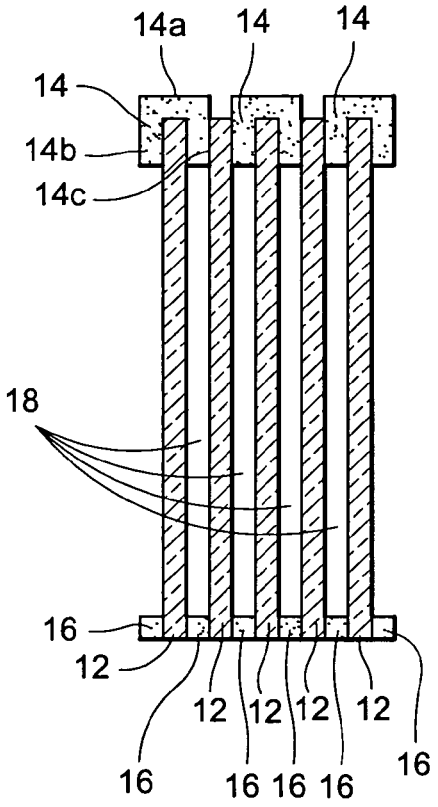
FIG. 2*a* is a front cross sectional view of a packaging technique in accordance with an example embodiment of this invention.
Figure 2B:
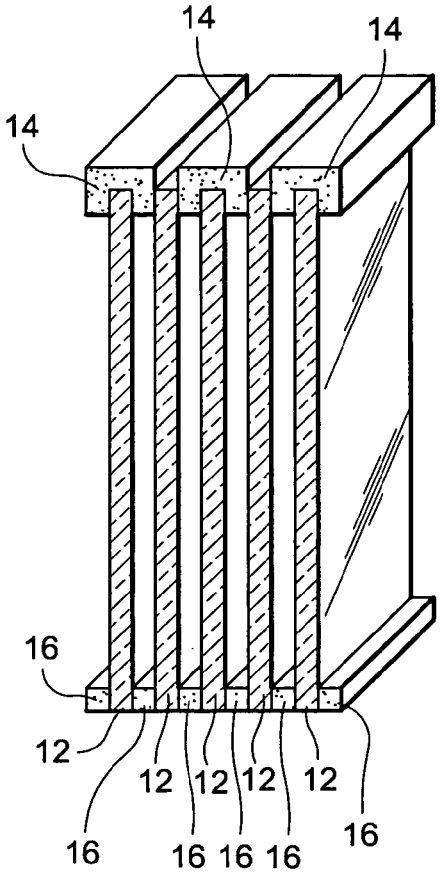
FIG. 2*b* is a perspective view of the packaging technique of FIG. 2*a*, in accordance with an example embodiment of this invention.

Referring now more particularly to the drawings in which like reference numerals indicate like parts throughout the several views, FIG. 2*a* is a front view of a packaging technique in accordance with an example embodiment, and FIG. 2*b* is a perspective view of the packaging technique of FIG. 2*a*, in accordance with an example embodiment. As can be seen by FIGS. 2*a* and 2*b*, each glass sheet (preferably, coated glass sheet such as FSM or the like) 12 has a top-end and a bottom end. A substantially U-shaped strip 14 is disposed at one end (e.g., the top end) of every-other glass sheet 12. Each substantially U-shaped strip 14 has a base portion 14*a* from which two substantially parallel legs 14*b-c* extend. It will be appreciated that the substantially U-shaped strip 14 also may be thought of as a strip having a channel for receiving a glass sheet 12.

At the other end (e.g., the bottom end) opposite legs 14*b-c* of the substantially U-shaped strips 14, substantially rectangular prism shaped strips 16 are located between glass sheets. Together, the legs 14*b-c* of the substantially U-shaped strips 14 and the substantially rectangular prism shaped strips 16 define large air gaps 18 between adjacent glass sheets 12. In certain example embodiments, the air gaps 18 are provided over at least about 50% of the surface area of the adjacent major surface of each adjacent glass sheet 12 (more preferably over at least about 60%, even more preferably over at least about 70% or 80% of the surface area of the adjacent major surface of each adjacent glass sheet).

As shown in FIG. 2*b* for instance, the substantially U-shaped strips 14 and the substantially rectangular prism shaped strips 16 are elongated so as to span the entire, or at least a majority of, widths of the glass sheets 12. However, the present invention is not limited to this configuration. For example, more than one substantially U-shaped strip 14 and/or substantially rectangular prism shaped strip 16 of a size smaller than the widths of the glass sheets 12 may be disposed across the top and/or bottom of the appropriate glass sheets. In other words, in certain example embodiments, segmented substantially U-shaped strips 14 and/or segmented substantially rectangular prism shaped strips 16 may be disposed around or at the top and bottom portions of the glass sheets 12.

Also, in certain example embodiments, substantially U-shaped strips 14 may be disposed at both ends of the glass sheets 12. In such a configuration, substantially U-shaped strips 14 may be disposed at the tops of the odd-numbered (e.g., first, third, fifth, etc.) glass sheets, and disposed at the bottoms of the even-numbered (e.g., second, fourth, sixth, etc.) glass sheets to maintain appropriate air gaps 18 between the glass sheets 12.

The strips 14 and/or 16 may be formed from any suitable material(s), preferably resilient and/or flexible material(s). For example, the strips may be a plastic, cork, foam, rubber, felt, vinyl, etc, which have resiliency and/or flexibility. The size of the substantially U-shaped strips 14 and/or the rectangular prism shaped strips 16 may be changed to vary the size of the air gaps created between glass sheets.

Figure 3A:
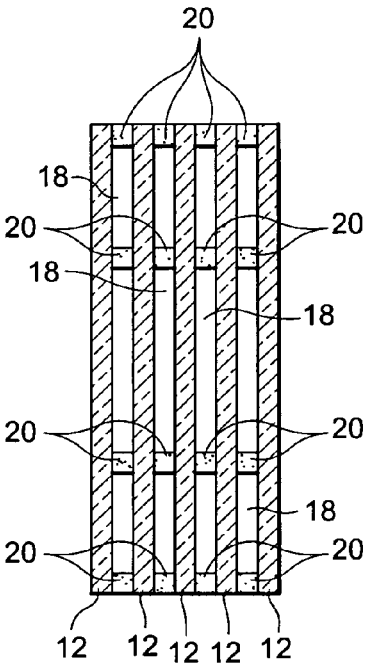
FIG. 3*a* is a front cross sectional view of another packaging technique in accordance with an example embodiment of this invention; and, FIG. 3*b* is a perspective view of the packaging technique of FIG. 3*a*, in accordance with an example embodiment.
Figure 3B:
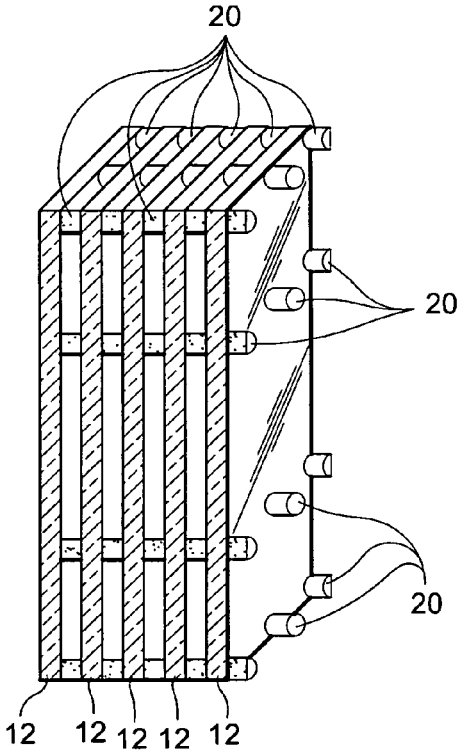

FIG. 3*a* is a front cross sectional view of another packaging technique in accordance with another example embodiment of this invention, and FIG. 3*b* is a perspective cross-sectional view of the packaging technique of FIG. 3*a*, in accordance with an example embodiment. As shown in FIGS. 3*a* and 3*b*, a series of spacer tabs 20 are disposed around or proximate the perimeter of the glass sheets (preferably coated glass sheets such as FSMs or low-E coated glass sheets) 12, creating various air gaps 18 both between glass sheets and between the tabs 20. Multiple tabs 20 may be disposed between each edge of at least some adjacent glass sheets 12. By way of example and without limitation, as shown in FIG. 3*b*, four tabs 20 are disposed along a first edge of a given glass sheets 12, while three tabs 20 are disposed along a second edge of the glass sheet 12, the first and second edges being substantially perpendicular to each other. However, more or less tabs 20 may of course be used.

It will be appreciated that the tabs 20 may be disposed around at least a portion of each glass sheet's perimeter. For example, the tabs 20 may be disposed around (or proximate) opposing edges of the glass sheets 12 only, around (or proximate) two perpendicular edges only, around (or proximate) any three edges, or around (or proximate) all four edges. Also, the tabs 20 may be disposed around different edges on a sheet-by-sheet basis.

The tabs 20 may be of any suitable size and shape and may be formed from any suitable material. By way of example and without limitation, the tabs 20 may be substantially cylindrically shaped, having diameters in the range of from about ⅜" to about ¾". Also by way of example and without limitation, the tabs 20 may be formed from cork, felt, vinyl, foam, rubber, polyurethane, etc. To create the sheet-to-sheet separation space, the tabs 20 may be disposed at predetermined intervals, or they may be disposed more arbitrarily around the perimeter of the glass sheets.

Also, as above, the thickness of the tabs 20 may be changed to vary the size of the air gaps created between glass sheets. In certain example embodiments, the tabs 20 also may be used in combination with, or in place of, the substantially U-shaped strips 14 and/or the rectangular prism shaped strips 16.

Although certain example embodiments are shown as having a particular number of glass sheets 12 (e.g., five glass sheets 12), it will be appreciated that the present invention is not so limited. Any number of glass sheets 12 may be stacked for storage and/or packaging. Also, certain example embodiments may allow the glass sheets 12 to be packaged and/or stored "standing up" and/or "lying down."

Moreover, the assembly including the glass sheets and strips and/or tabs may be placed within any suitable package, crate, or the like to facilitate transportation and/or storage of the same. To this end, the strips and/or tabs may be built into and/or formed on edges of the package, crate, etc., rather than being separate structures.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A kit comprising:

a plurality of first surface mirrors including glass sheets supporting coatings; and a packaging system for holding the plurality of first surface mirrors in a package in substantially parallel spaced-apart relation to each other, the system comprising:

a plurality of resilient and flexible substantially U-shaped strips, each said substantially U-shaped strip being disposable around at least part of a first edge of every other first surface mirror of the plurality of first surface mirrors when said first surface mirrors are placed in the package, wherein the substantially U-shaped strips comprise a base from which two legs extend downward in a substantially parallel manner along opposing major sides of the corresponding first surface mirror when said first surface mirrors are placed in the package; and a plurality of second strips, each said second strip being disposed at or proximate a second edge, opposite the first edge, of every glass sheet of the plurality of first surface mirrors so as to form air gaps between adjacent first surface mirrors of the plurality of first surface mirrors when said first surface mirrors are placed in the package, wherein the substantially U-shaped strips and/or the second strips are integrally formed as a part of the package, wherein the substantially U-shaped strips and the second strips are formed from one or more of plastic, cork, foam, rubber, felt, and vinyl, and the air gaps are provided over at least about 70% of a surface area of the major side of each adjacent first surface mirror.

2. The kit of claim 1, wherein each substantially U-shaped strip is elongated so as to run along substantially the entire first edge of a corresponding one of the first surface mirrors when said first surface mirrors are placed in the package, and each second strip is elongated so as to run along or proximate substantially the entire second edge of a corresponding one of the first surface mirrors when said first surface mirrors are placed in the package.

3. The kit of claim 1, wherein the second strips are not substantially U-shaped.

4. The kit of claim 1, wherein the second strips are also substantially U-shaped, and wherein substantially U-shaped strips at the first edge of the first surface mirrors are provided around the first edge of only even-numbered first surface mirrors of the plurality of first surface mirrors when said first surface mirrors are placed in the package, and substantially U-shaped strips at the second edge of the first surface mirrors are provided around the second edge of only odd-numbered first surface mirrors of the plurality of first surface mirrors when said first surface mirrors are placed in the package.

5. The kit of claim 1, wherein the package includes the plurality of first surface mirrors, and wherein first edge is a top edge and the second edge is a bottom edge of the first surface mirror(s).

6. A kit comprising:

a plurality of coated glass sheets; and a packaging system for the coated glass sheets comprising:

a package for holding the plurality of coated glass sheets in substantially parallel spaced-apart relation to each other comprising a plurality of discrete and spaced apart flexible and/or resilient tabs disposable proximate at least a portion of each coated glass sheet's perimeter such that the tabs separate the coated glass sheets so as to create air gaps between adjacent coated glass sheets when said coated glass sheets are placed in the package, and wherein said tabs have a diameter from about ⅜ to ¾inches; and wherein said tabs are provided only along two edges of the glass sheets, and not along the other edges of the glass sheets; and wherein the air gaps are provided over at least about 70% of a surface area of the major side of each adjacent coated glass sheet.

7. The kit of claim 6, wherein the tabs are disposed at least proximate opposing edges of each glass sheet's perimeter when said glass sheets are placed in the package.

8. The kit of claim 6, wherein a plurality of the tabs comprise plastic, rubber, foam, cork, felt, and/or vinyl.

9. A kit comprising:

a plurality of glass sheets; and a packaging system for holding, in a package, the plurality of glass sheets in substantially parallel spaced-apart relation to each other, comprising:

a plurality of spaced apart first spacers;

a plurality of spaced apart second spacers, wherein each second spacer is associated with at least one first spacer so as to define air gaps between adjacent glass sheets of the plurality of glass sheets when said glass sheets are placed in the package, wherein the first spacers and second spacers are disposed proximate at least opposite edges of the glass sheets when said glass sheets are placed in the package, and wherein each said spacer is integrally formed as a part of the package, and wherein the first and second spacers are formed from one or more of plastic, cork, foam, rubber, felt, and vinyl; and wherein the air gaps are provided over at least about 70% of a surface area of the major side of each adjacent glass sheet.

10. The kit of claim 9, wherein the first spacers are substantially U-shaped and each are arranged to receive an edge of a corresponding glass sheet in a channel thereof.

11. The kit of claim 10, wherein the second spacers are not substantially U-shaped, and have no channel defined therein for receiving glass sheets.

12. The kit of claim 10, wherein each of the first and second spacers are substantially U-shaped.

13. The kit of claim 10, wherein the first and second spacers are both substantially U-shaped, and wherein the first spacers are disposed at a first edge of the glass sheets and are provided around the first edge of only even-numbered glass sheets of the plurality of glass sheets when said glass sheets are placed in the package, and the second spacers are disposed at a second edge, opposite the first edge, of the glass sheets and are provided around the second edge of only odd-numbered glass sheets of the plurality of glass sheets when said glass sheets are placed in the package.

* * * * *